United States Patent [19]

Schröder

[11] Patent Number: 4,736,430

[45] Date of Patent: Apr. 5, 1988

[54] HEARING AID

[75] Inventor: Karl-Heinz Schröder, Berlin, Fed. Rep. of Germany

[73] Assignee: Robert Bosch GmbH, Stuttgart, Fed. Rep. of Germany

[21] Appl. No.: 804,690

[22] Filed: Dec. 4, 1985

[30] Foreign Application Priority Data

Jan. 18, 1985 [DE] Fed. Rep. of Germany ..... 3501481

[51] Int. Cl.[4] ..... H04R 25/02; H04R 25/00

[52] U.S. Cl. ..... 381/68.6; 381/69.2

[58] Field of Search ..... 179/107 E, 107 R; 381/69, 68.4, 68.6, 68, 69.2; 381/69; D24/35

[56] References Cited

U.S. PATENT DOCUMENTS

| | | | |
|---|---|---|---|
| D. 102,655 | 1/1937 | Nicholides | D24/35 |
| D. 105,261 | 7/1937 | Breen | D24/35 |
| 2,064,426 | 12/1936 | Greibach | D24/35 |
| 2,477,046 | 7/1949 | Davenport | 381/68.6 |
| 2,486,534 | 11/1949 | Medlin | 381/187 |
| 2,506,490 | 5/1950 | Coley | 381/187 |
| 2,595,672 | 5/1952 | Greenwood | 381/69 |
| 2,808,468 | 10/1957 | Knauert | 381/187 |
| 2,964,596 | 12/1960 | Christensen | 381/68.6 |
| 3,394,698 | 7/1968 | Calkins | 381/72 |
| 3,745,049 | 7/1973 | Kaye | 429/97 |
| 3,783,201 | 1/1974 | Weiss et al. | 381/68.6 |
| 4,550,227 | 10/1985 | Topholm | 381/69 |
| 4,585,089 | 4/1986 | Topholm | 381/68.6 |
| 4,672,672 | 6/1987 | Eggert et al. | 381/69 |

FOREIGN PATENT DOCUMENTS

| | | | |
|---|---|---|---|
| 298293 | 12/1915 | Fed. Rep. of Germany . | |
| 2236112 | 1/1974 | Fed. Rep. of Germany . | |
| 8323464 | 12/1983 | Fed. Rep. of Germany . | |
| 3406972 | 8/1985 | Fed. Rep. of Germany | 179/107 R |
| 3425211 | 8/1985 | Fed. Rep. of Germany | 381/69.2 |
| 3505390 | 8/1985 | Fed. Rep. of Germany | 179/107 R |
| 1259517 | 1/1972 | United Kingdom . | |

*Primary Examiner*—Jin F. Ng
*Assistant Examiner*—Danita R. Byrd
*Attorney, Agent, or Firm*—Frishauf, Holtz, Goodman & Woodward

[57] ABSTRACT

To provide for better fitting and pleasing out appearance of a hearing aid having an element introducible into the ear canal of a user, and an externally accessible housing which retains electronic components, a battery, and ON/OFF switch and volume control elements, the housing is formed in spherical or, rather, truncated-spherical shape, removably fitted on a fitting element introduced into the ear canal. This spherical shape is less obtrusive than others, and may be formed similar to costume jewelry.

11 Claims, 2 Drawing Sheets

HEARING AID

REFERENCE TO RELATED PUBLICATION

German Utility Model DE-GM No. 83 23 464, to which U.S. Pat. No. 4,550,227, Topholm, corresponds.

The present invention relates to an electronic hearing, and more particularly to a hearing aid which is made of two parts, one of which retains electronic circuitry and the other one forms a sound duct adapted to be introduced into the ear canal of a wearer or user.

BACKGROUND

It has previously been proposed to provide hearing aids in form of small cylindrical elements which include a sound duct structure individually fitted to be introduced into the ear canal of a user, hereinafter, for short, the fitted element. The cylindrical structure, in which the fitted element terminates, is closed off at the far side by a cover which is movable with respect to the remainder of the structure, for example rotatable, to form an ON/OFF switch and a volume control for the hearing aid. This structure has an advantage that only the fitted element must be individually made for the user, the remainder of the housing being of standard construction. Thus, contrary to structures which require individual fitting of the entire hearing aid housing,it is only necessary to individually fit the fitted element. It has been found that the cylindrical housing structure, due to its shape, and depending on the shape of the ear of the user, may project undesirably from the outer ear of the user and may, for some users, press against folds or other parts of the outer ear of the user.

THE INVENTION

It is an object to provide a hearing aid which will fit well against the outer ear, is comfortable, and does not interfere with wearing comfort.

Briefly, the housing is largely spherical and, more particularly, in form of a cub or truncated sphere, so that, in overall aspect, the hearing aid has the appearance of a pearl set against the ear canal, fitting against the entrance to the ear canal without presenting any sharp discontinuities either towards the ear or towards the outside.

In accordance with a preferred embodiment, the spherical housing is split in a plane parallel to a diametrical plane to form first and second larger and smaller housing portions, in which the second housing portion can be arranged to be rotatable with respect to the first and form an ON/OFF switch and volume control combination. The manually adjustable switch and volume control thus is readily accessible without interfering with the general spherical or pearl shape of the hearing aid.

The structure has the advantage that it is readily adaptable to practically any user or wearer, will not interfere with the anatomical structure of the ear immediately adjacent the mouth of the ear canal and can be made, selectively, to be unobtrusive or in form of costume jewelry.

DRAWINGS

FIG. 1, on the original drawing size, illustrates the complete hearing aid in approximately 1:1 scale;

FIG. 2 is a highly enlarged side view, partly in section, of the hearing aid housing; and FIG. 3 is a side view to the same scale as FIG. 2 of an alternate embodiment.

DETAILED DESCRIPTION

Figure 2:
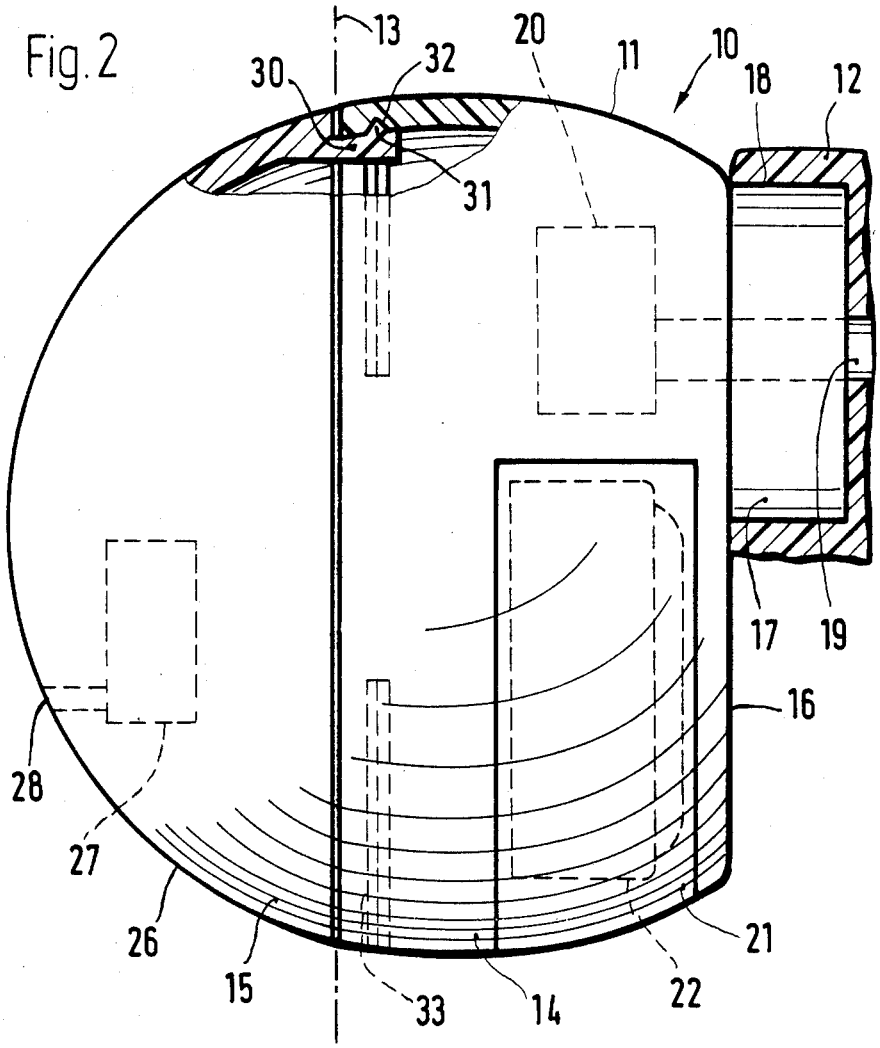
Figure 1:
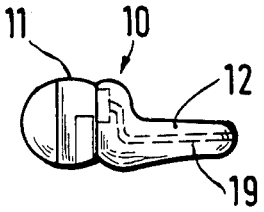

A hearing aid 10—see FIGS. 1 and 2—has a hollow, essentially spherical or pearl-shaped structure 11,and a fitting element 12, which is separably connected, for example by a push-on interference fit with the housing structure 11. The housing 11 is separated into two housing parts along a separating plane 13. Plane 13 extends parallel to a diametrical plane and, preferably, essentially at right angles to an axis through a hearing duct 19 which leads into the fitted element 12. The housing, thus, includes a first or larger housing portion 14 including the maximum sphere diameter measured transversely to said axis and a second or smaller housing portion 15 in form of a part-spherical cap, which portions, when fitted together, form, essentially, a cut or truncated sphere. The first housing portion or part 14 is formed with a flattened surface 16, extending at least approximately parallel to the separating plane 13. A stub 17 extends from the flattened surface 16. The first housing part 14 and the stub 17 preferably are made as a unitary plastic element. The fitted element 12 is secured on the stub 17 by engagement of a collar 18 thereof over the stub 17. The stub 17 is hollow, and permits sound to pass through a sound duct 19 formed within the inside of the fitted element 12—see FIG. 1. The stub 17 is in aural communication with a speaker or transducer element 20, transducing electrical signals into sound waves to be transmitted through the duct 19. The first housing part additionally includes a battery flap 21, externally fitting around and matching the spherical shape of the housing, and which can be pivoted outwardly from the housing to provide access to a battery compartment 22 for introduction of a primary or of a rechargeable battery thereinto. The first housing part, additionally, retains therein electronic components, as well known in the hearing aid field technology.

The second and smaller housing part 15 forms a rotatable control element 26 for a volume control and an ON/OFF switch of the hearing aid. The control element 26 can be grasped, being at the outside of the ear; to facilitate grasping and rotating the surface of the control element 26, it is preferably formed with a knurled or ribbed surface; the knurling or ribbing has been omitted from FIG. 2 for clarity of the drawing. The second housing part 15 also retains a microphone, shown only schematically at 27, and coupled to outside ambient air, for reception of sound waves, by a sound entrance opening 28. Electrical or electronic components within the second housing part 15 also have been omitted from the drawing for clarity. They can be connected, by flexible cable or suitable slide contacts, with the electronic components (not shown) within the housing part 14.

The first and second housing parts 14, 15 are rotatably connected together. A simple and effective connection is formation of resilient projections 30 on the second housing part 15 on two diametrically oppositely located positions—see top of FIG. 1—which include externally extending projections 31 which fit into a ring-shaped groove 32, 33 formed in the first housing part 14. The grooves 32, 33 preferably have a length which limits the angle of rotation of the second housing part 15 with respect to the first, corresponding to the adjustment angle of the ON/OFF switch and volume control combination of the hearing aid.

Figure 3:
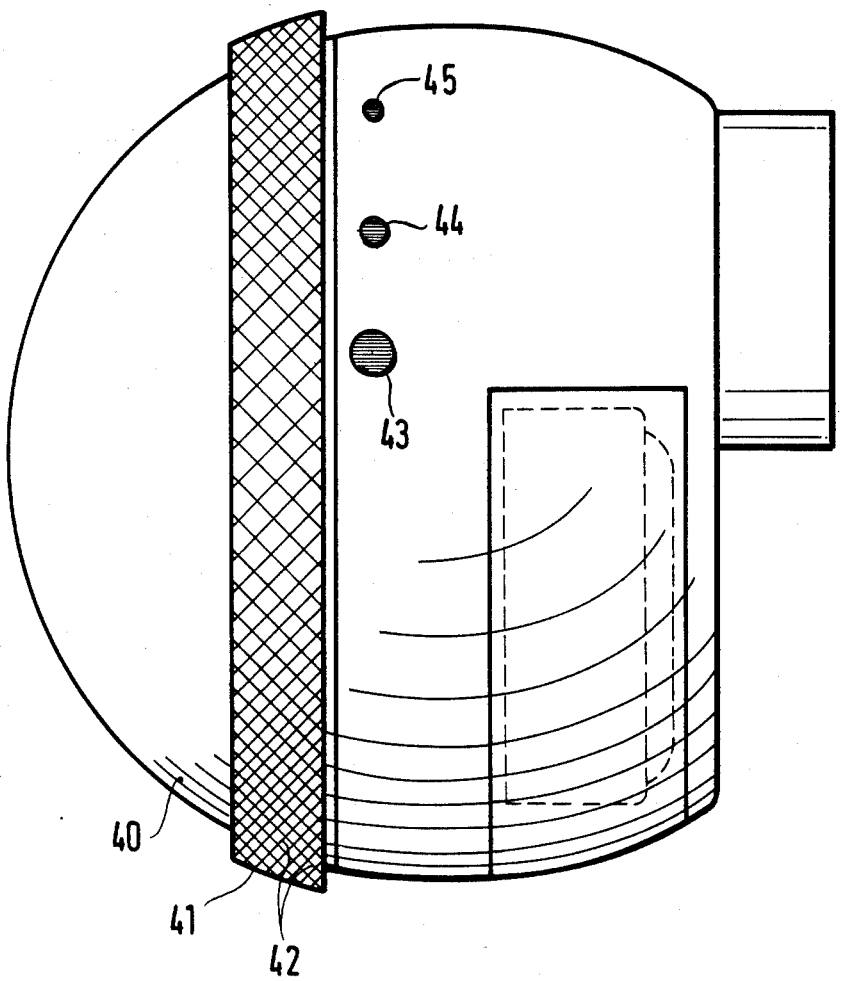

Embodiment of FIG. 3: Rather than splitting the housing parts, a single, part-spherical housing 40 can be provided which carries an adjustment ring 41, fitting about the spherical housing and located at a portion thereof which is readily externally accessible. Preferably, ring 41 is formed with a criss-cross ribbing or knurling to facilitate operation of an ON/OFF switch and volume control combination coupled to the ring 41. The switch and volume control are not separately shown since they are standard components and will be located within the essentially part-spherical housing 40.

The adjustment ring 41, with the knurling thereon, can also be applied to the circumference of the second housing part 15 (FIG. 1) and may be unitary therewith.

A suitable material for the housing of the hearing aid is a plastic. To provide visual and/or tactile indication of the operation of the volume control, dot-shaped markers 43, 44, 45, of decreasing size, can be located adjacent the outer edge of the second housing part 15, or 40, respectively, or adjacent the adjustment ring 41, to indicate the direction of decreasing volume of operation of the hearing aid.

Various changes and modifications may be made within the scope of the inventive concept.

What is claimed is:

1. Hearing aid having a body defining a housing (11) adapted to be located, at least in part, against an ear canal of an ear of a wearer;

operating components (20, 22, 27) located within the housing;

means for defining a sound duct (19) coupled to the housing to transfer sound towards the inner ear of the wearer;

wherein the body defining the housing is essentially in the shape of a truncated sphere formed with a flattened surface (16), said flattened surface extending parallel to a diametrical plane;

the body is divided along a separating plane (13) essentially parallel to said flattened surface into two parts defining first and second parts (14, 15);

wherein the first part (14) extends from said separating plane to said flattened surface, and the second part (15) is shaped to define an essentially spherical cap, fitted against said separating plane, is rotatable with respect to said first part (14), and forms a movable means coupled to the operating components in the housing for controlling volume of sound being transferred to the sound duct (19);

wherein a hollow cylindrical stub (17) is provided, extending from said flattened surface (16); and wherein the means for defining the sound duct (19) are fitted against said stub, the sound duct extending through said stub.

2. A hearing aid according to claim 1, wherein the second housing part (15) is formed with inwardly extending resilient projections (30) projecting towards the first part;

and ring-shaped groove means (32) are formed in an inner wall portion of the first housing part (14) and shaped to receive said projections in matching engagement.

3. A hearing aid according to claim 1, further including a battery cover flap (21) movably secured at an outer surface of the housing, and having an outer shape matching the spherical shape of the housing.

4. A hearing aid according to claim 1, further including a fitting element (12) adapted to fit within the ear canal of the ear of the wearer, said fitting element being formed with at least part of said sound duct (19) and being in engagement with said hollow cylindrical stub (17) and form part of the sound duct defining means.

5. A hearing aid according to claim 4, wherein the fitting element is formed with an engagement collar (18) fitting over said cylindrical stub (17).

6. A hearing aid according to claim 1, wherein the spherical outer surface of the first part positioned between said separating plane (13) and the flattened surface (16) is located in the region including the maximum diameter of the truncated sphere, measured in a plane parallel to said separating plane.

7. A hearing aid having a rotation-symmetrical body defining a housing (11) adapted to be located, at least in part, against an ear canal of an ear of a wearer, operating components (20, 22, 27) located within the housing;

means for defining a sound duct (19) coupled to the housing to transfer sound towards the inner ear of the wearer;

wherein the body defining the housing is essentially in the shape of a truncated sphere formed with a flattened surface parallel to a diametrical plane;

and an adjustment ring (41) on the housing and forming a movable means, coupled to the operating components in the housing for controlling the volume of sound being transferred to the sound duct.

8. A hearing aid according to claim 7, wherein the body is divided into two parts deifning first and second parts along a separating plane extending parallel to said diametrical plane;

and wherein the second part (15) is rotatable with respect to said first part (14) and is coupled to said adjustment ring (41).

9. A hearing aid according to claim 8, wherein the means defining the sound duct (19) is coupled to the first part (14).

10. A hearing aid according to claim 7, further including a battery cover flap (21) movably secured at an outer surface of the housing, and having an outer shape matching the spherical shape of the housing.

11. A hearing aid according to claim 7, further comprising a hollow cylindrical stub (17) extending from said flattened surface (16);

and wherein the means for defining the sound duct (19) are fitted against said stub, the sound duct extending through said stub.

* * * * *